US011377188B2

(12) United States Patent
Depentori

(10) Patent No.: US 11,377,188 B2
(45) Date of Patent: Jul. 5, 2022

(54) SAILDRIVE ARRANGEMENT

(71) Applicants: ZF FRIEDRICHSHAFEN AG, Friedrichshafen (DE); ZF PADOVA SRL, Caselle di Selvazzano (IT)

(72) Inventor: Paolo Depentori, Dro (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 483 days.

(21) Appl. No.: 16/492,336

(22) PCT Filed: Jan. 23, 2018

(86) PCT No.: PCT/EP2018/051493
§ 371 (c)(1),
(2) Date: Sep. 9, 2019

(87) PCT Pub. No.: WO2018/162137
PCT Pub. Date: Sep. 13, 2018

(65) Prior Publication Data

US 2021/0129968 A1 May 6, 2021

(30) Foreign Application Priority Data

Mar. 10, 2017 (DE) ..... 10 2017 203 979.5

(51) Int. Cl.
*B63H 23/35* (2006.01)
*B63H 23/08* (2006.01)
*B63H 23/30* (2006.01)

(52) U.S. Cl.
CPC ..... *B63H 23/35* (2013.01); *B63H 23/08* (2013.01); *B63H 23/30* (2013.01); *B63H 2023/305* (2013.01)

(58) Field of Classification Search
CPC ..... B63H 23/35; B63H 23/08; B63H 23/30; B63H 2023/305
See application file for complete search history.

(56) References Cited

U.S. PATENT DOCUMENTS 278,182 A 5/1883 Reynolds
4,451,238 A * 5/1984 Arnold ..... F16H 3/14 477/92

(Continued)

FOREIGN PATENT DOCUMENTS

CH 502 1 22 3/1971
DE 33 32 1 35 A1 3/1984

(Continued)

OTHER PUBLICATIONS

Written Opinion filed in corresponding PCT Application No. PCT/EP2018/081493 dated Feb. 13, 2019.

(Continued)

*Primary Examiner* — Andrew Polay
(74) *Attorney, Agent, or Firm* — Finch & Maloney PLLC; Michael J. Bujold; Jay S. Franklin

(57) ABSTRACT

A saildrive arrangement (1) which comprises an upper unit (13) to be positioned inside a hull (5) of a sailboat (7) and a lower unit (14) which is arranged to protrude from the bottom (6) of the hull (5). The upper unit (13) comprises an input shaft (4) to be connected to an engine (2) and the lower unit (14) comprises a propeller shaft (9). A brake (15), for locking the rotational movement of the propeller shaft (9), is located in the upper unit (13). The saildrive arrangement (1) is incorporated into a sailboat (7) with a hull (5) and an engine (2).

12 Claims, 3 Drawing Sheets

(56) References Cited

U.S. PATENT DOCUMENTS

| | | | | |
|---|---|---|---|---|
| 7,506,737 | B2 | 3/2009 | Okanishi et al. | |
| 2008/0072822 | A1 | 3/2008 | White | |
| 2008/0220669 | A1* | 9/2008 | Imanaka | B63H 23/26 440/5 |
| 2014/0291079 | A1* | 10/2014 | Bianchi | F16D 49/16 188/67 |
| 2017/0069468 | A1 | 3/2017 | Schlemm et al. | |
| 2017/0307037 | A1 | 10/2017 | Langenbeck et al. | |
| 2019/0265708 | A1* | 8/2019 | Zottele | B63H 25/38 |

FOREIGN PATENT DOCUMENTS

| | | | |
|---|---|---|---|
| DE | 10 2012 110 287 | A1 | 4/2014 |
| EP | 2 915 901 | A1 | 9/2015 |
| EP | 3708481 | A1 * | 9/2020 |
| GB | 1 314 041 | | 4/1973 |

OTHER PUBLICATIONS

International Search Report filed in corresponding PCT Application No. PCT/EP2018/081493 dated Feb. 13, 2019.
German Search Report filed in corresponding German Application No. 10 2017 203 979.5 dated Feb. 8, 2018.

* cited by examiner

SAILDRIVE ARRANGEMENT

This application is a national stage completion of PCT/EP2018/051493 filed Jan. 23, 2018 which claims priority from German Application Serial No. 10 2017 203 979.5 filed Mar. 10, 2017.

FIELD OF THE INVENTION

The present invention concerns a saildrive arrangement with an upper unit to be positioned inside a hull of a sailboat and a lower unit which is arranged to protrude from the bottom of the hull, wherein the upper unit comprises an input shaft to be connected to an engine and the lower unit comprises a propeller shaft. The invention further relates to a sailboat with a hull and with a corresponding saildrive.

BACKGROUND OF THE INVENTION

In recent years saildrives have become more and more common on modern sailboats. A saildrive is a motorized drive system for a sailboat. The horizontally aligned input shaft of a typical saildrive is driven by an inboard engine.

Said input shaft drives via an upper bevel gear mechanism a vertical intermediate shaft extending downward through the bottom of the sailboats hull. The input shaft and the upper bevel gear mechanism are parts of an upper unit which is fastened inside the hull. The intermediate shaft drives at its lower end via a lower bevel gear mechanism a horizontal propeller shaft which is supported in a lower unit of the saildrive beneath the hull. There are steerable saildrives which have a pivotable lower unit, which can be turned around a vertical axis to influence the steering of the sailboat and there are saildrives with a fixed lower unit. Sailboats with a fixed lower unit do the steering mainly by the rudder of the sailboat.

Traditional sailboat propulsion systems instead have a horizontal output shaft extended rearward from the engine. The output shaft being coupled to a propeller shaft which extends through the stern via a stuffing box and the propeller is mounted at a downward angle. Compared to these traditional sailboat propulsion systems a saildrive takes less space in the stern of the sailboat, its propeller shaft is oriented horizontal with the effect of high thrust efficiency, and it causes less vibration and noise during operation.

It is known for a long time that a sailing vessel which can also be driven by a propeller faces undesired drag by the propeller when the vessel is under sail. A solution for this problem has already been proposed in U.S. Pat. No. 278,182 in the year 1882. This solution proposed a locking device on the propeller shaft for locking the propeller in such position that its two blades will be maintained in a position behind a stern-post when desired.

Another possibility to minimize drag losses of a propeller is the use of folding propellers. A folding propeller is a type of propeller whose blades automatically fold out when the propeller shaft rotates at least with a certain speed, and then fold back when rotation stops. Generally it is intended to have the blades of the folding propeller fold in when the engine is stopped in order to reduce drag in this situations. But even with folded blades of such a folding propeller the water flow around the blades during sailing can force the propeller into rotation, thus leading to partially, if not completely, open blades which would again result in undesired drag for the vessel.

In the U.S. Pat. No. 7,506,737 B2 it is proposed to use a locking device on an output shaft of a marine reversing gear assembly which can be used with a traditional sailboat propulsion system. The locking device in this marine reversing gear assembly locks the output shaft by the energizing force of a locking spring when the combustion engine is not operating. Essential parts of the locking device are fixed on the external surface of a housing that supports the output shaft.

SUMMARY OF THE INVENTION

An object of the present invention is to provide a saildrive arrangement which allows a saildrive and a sailboat with improved performance and efficiency. These objects are attained by the present invention.

The present invention provides a saildrive arrangement comprising an upper unit to be positioned inside a hull of a sailboat and a lower unit which is arranged to protrude from the bottom of the hull. The upper unit comprises an input shaft to be connected to an engine and the lower unit comprises a propeller shaft. A brake to lock the rotational movement of the propeller shaft is located in the upper unit. This means that all parts of the brake are located inside the hull. The brake can be located inside a housing of the upper unit. The rotation of the propeller shaft can be stopped and locked by the brake so that a propeller which is fixed to the propeller shaft cannot rotate.

An important aspect of the invention is the fact, that any element of the saildrive arrangement which is located outside the hull will cause more disturbances in the water flow and undesired drag. Any additional element outside the hull increases the space outside the hull which is necessary to accommodate the element, for example in a casing of the lower unit. One aim of the invention is therefore to minimize the amount of elements outside the hull and to integrate as much of the elements as possible inside the hull in a preferably compact construction.

The location of the brake in the upper unit, hence inside the hull instead of outside, helps to reduce the protrusion of saildrive elements into the water flow paths around the hull, thereby reducing unwanted disturbances in the water flow around the hull and around the lower unit of the saildrive. This improves the planing characteristics of the sailboat and the thrust efficiency of the saildrive.

Generally the invention can be applied to saildrives with fixed blade propellers and to saildrives with folding propellers. In case of a folding propeller, the propeller blades will stay in the folded in condition due to the locked propeller shaft. The undesired drag in the water flow around the lower unit of the saildrive with the propeller can be significantly reduced. This allows higher speed of the sailboat. Reduced fuel consumption can be achieved when the sailboat is driven by a first saildrive while the engine of a second saildrive is not running and the second propeller is folded in due to the locked second propeller shaft.

According to a preferred embodiment the upper unit of the saildrive arrangement comprises an upper bevel gear mechanism connecting the input shaft to an intermediate shaft and the lower unit comprises a lower bevel gear mechanism connecting the intermediate shaft to the propeller shaft. This means that the intermediate shaft extends from the upper unit to the lower unit connecting the upper bevel gear mechanism with the lower bevel gear mechanism. The lower bevel gear mechanism and the propeller shaft are arranged in the lower unit. Such an arrangement of the shafts and bevel gear mechanisms allows the typical saildrive layout with the horizontal input shaft aligned to a horizontal crank shaft of the engine, with the intermediate shaft arranged vertically and the propeller shaft arranged horizontally, so that the propeller can rotate around a horizontal axis. The horizontal rotation axis of the propeller increases the thrust efficiency of the saildrive compared to a traditional sailboat propulsion system with a propeller rotating at a downward angle. The invention can be applied with steerable saildrives and with fixed saildrives. Steerable saildrives have a lower unit which can be turned around a vertical axis to influence the steering of the sailboat by the pivotable thrust vector of the propeller, while the lower unit of a fixed saildrive is fixed to an upper unit or to the hull.

The term horizontal, as used in this description and in the accompanying claims, means that the related element is generally horizontal when the vessel is in an upright position and floating in water such that a vertical element is substantially normal, i.e. perpendicular to a top surface of the water.

A rotatable element of the brake can be rotationally fixed to a hub of a first bevel gear of the upper bevel gear mechanism and a stationary element of the brake can be rotationally fixed to a housing of the saildrive arrangement. Hence, the rotatable element of the brake and the hub of the first bevel gear are arranged to rotate together around a common rotation axis while the stationary element is fixed to the housing, at least in rotational direction. Said housing preferably is the housing of the upper unit which encases the upper bevel gear mechanism and the brake. In other embodiments said housing could also be a common housing of the upper unit and the lower unit. The rotation axis of the first bevel gear can be the rotation axis of the input shaft. This means that the brake in this embodiment is located in the immediate vicinity of the input shaft, what enables a very compact design also of the upper unit. This is advantageous to have more free space available inside the hull.

Preferably the first and the second element comprise at least one friction disk, so that the brake can be formed for example as a multi-disk brake. The friction type brake is better than a form-locking devices, because in case any overload occurs the friction brake will slip and not break any mechanical part. The friction disks of the rotatable and the stationary element of the brake provide friction surfaces which cause the brake effect when pressed against each other by a friction force. The friction force can be provided by an elastic element like a spring for locking the propeller shaft.

According to another preferred embodiment of the invention the brake is engageable by a locking spring and disengageable by hydraulic pressure provided by a hydraulic pump which is driven by the input shaft. With other words the brake is spring-actuated and hydraulically released. Such a brake is also called a negative brake.

With this embodiment it can be ensured that a rotation of the propeller shaft is prevented when the engine is not running. The locking spring shall have such a spring tension and force, that an engagement of the brake and the standstill of the propeller shaft are ensured, as long as the engine of the saildrive is not running and the hydraulic pump is not driven.

According to a further preferred embodiment the upper bevel gear mechanism comprises the first bevel gear and a second bevel gear which are both arranged rotatable around a rotation axis of the input shaft and both are constantly meshing with a third bevel gear which is rotationally fixed to the intermediate shaft, wherein the first and the second bevel gear are selectively fixable to the input shaft by a first and a second clutch in order to engage a forward or reverse propulsion direction.

In such an arrangement the first clutch and the second clutch can both be hydraulic multi-disk clutches which are selectively engageable by a pressure provided by the hydraulic pump which is driven by the input shaft. With regard to the target of a compact size of the saildrive arrangement it is preferred to have the hydraulic pump, the brake and the first and second clutch located in the immediate vicinity of the inlet shaft.

The same hydraulic pump which provides the hydraulic oil and pressure for the disengagement of the brake can also be used to provide the hydraulic oil and pressure for the first and second clutch. This way a simple and cost-efficient layout of the hydraulic system of the saildrive can be achieved. Preferably all components of the hydraulic system for the brake and the first and second clutch are part of the upper unit or located inside the housing of the upper unit.

A further improvement related to compact size and simple construction can be reached, if there are hydraulic pressure channels provided inside the input shaft to connect the hydraulic pump with the first clutch and the second clutch. More precisely the pressure channels connect the outlet of the hydraulic pump with pressure chambers of the first and second clutch. A hydraulic valve can be provided in these hydraulic lines to select the desired clutch.

In order to achieve a very compact design of the saildrive arrangement, the hydraulic pump can be positioned inside a cover of a housing of the upper unit of the saildrive arrangement. The cover can for example be a sealing cover or a bearing cover at the feedthrough of the input shaft. The pressure side of the hydraulic pump can be advantageously connected to the pressure chambers of the brake by pressure channels inside the walls of said housing.

Especially for applications with a fixed propeller one embodiment of the invention provides a brake which can be mechanically disabled by a disabling element. Such a saildrive arrangement can be equally applied on sailboats with folding and fixed propellers without constructive modification. In applications with folding propellers the brake can be enabled to block propeller rotation during sailing, whereas in applications with fixed propellers the brake can be mechanically disabled to allow propeller rotation during sailing.

In a disabling position the disabling element can positively lock the pressure piston of the brake in a disengaged position of the brake, so that the brake is mechanically disabled. In an idle position of the disabling element the pressure piston of the brake is not blocked by the disabling element. Preferably the disabling element is a threaded pin which can be screwed into a housing of the saildrive arrangement until a front part of the disabling element positively locks the pressure piston of the brake in the disengaged position.

The invention covers a sailboat with a hull and a saildrive that comprises an engine which is positioned inside said hull and a saildrive arrangement as described above. The high degree of integration of functions and elements inside the upper unit of the saildrive enables a very compact and slim design of the whole saildrive arrangement. Especially the integration, of the brake inside the upper unit instead of the lower unit enables a slim and streamlined design of the lower unit and its fairing. This way the planing characteristics of the sailboat and the thrust efficiency of the saildrive are enhanced.

BRIEF DESCRIPTION OF THE DRAWINGS

The following detailed description of a preferred embodiment of the invention in connection with the accompanying drawings will help to understand the objects, features and advantages of the invention, wherein.

DETAILED DESCRIPTION OF THE INVENTION

Figure 1:
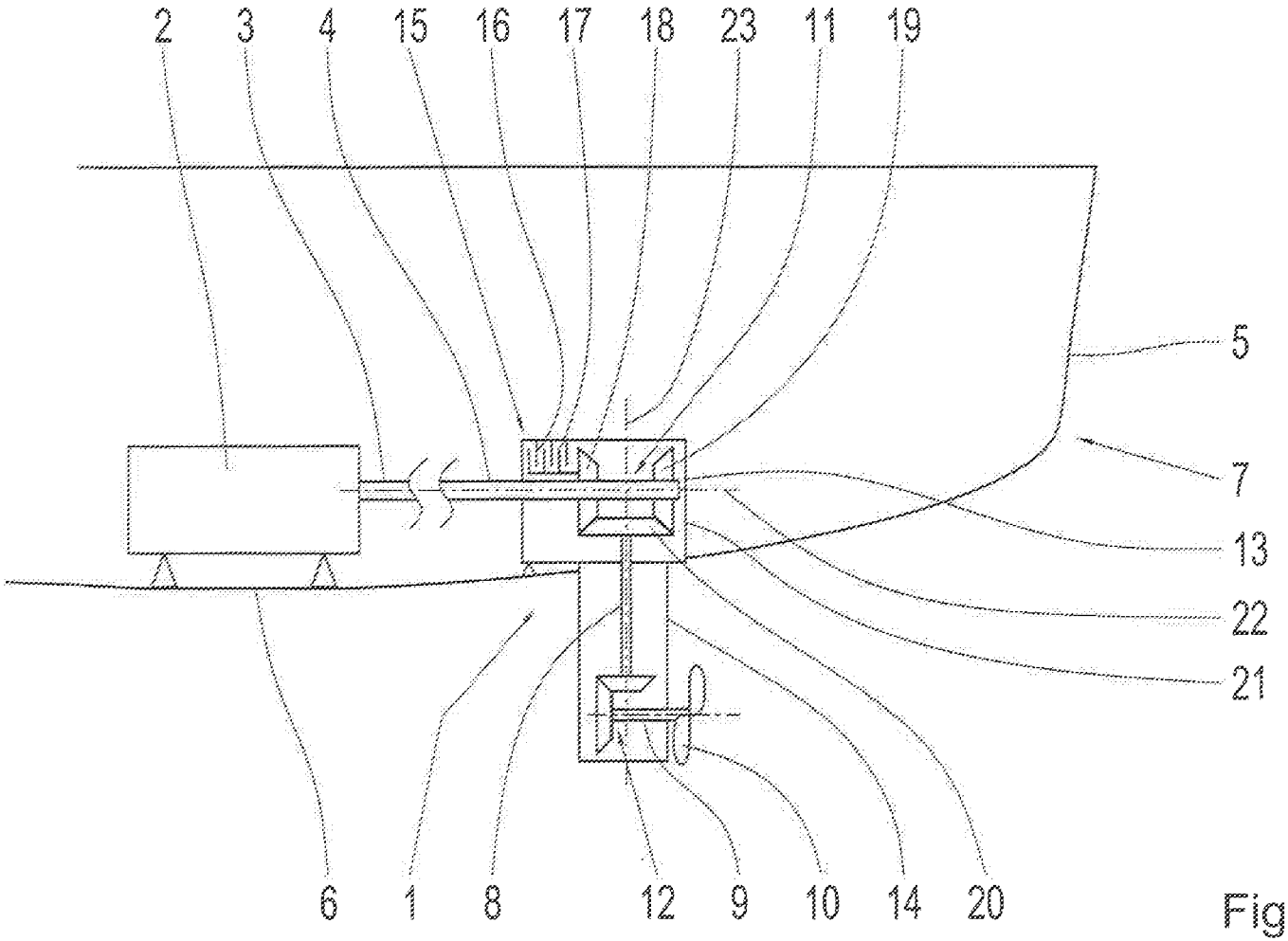
FIG. 1 shows a schematic layout of a saildrive and an arrangement according to the invention.

A saildrive arrangement 1 can be seen in FIG. 1. It is driven by an engine 2, for example an internal combustion engine, which is located inside the hull 5 of a sailboat 7. The output shaft 3 of the engine 2 is coupled to an input shaft 4 of the saildrive arrangement 1. Input shaft 4 enters into a housing 21 of an upper unit 13. The upper unit 13 is also located inside the hull 5. The engine 2 and the upper unit 13 are fastened to the hull 5 or to structural parts inside of the hull 5.

The upper unit 13 includes an upper bevel gear mechanism 11 and a brake 15 in the form of a multi-disk brake. The upper bevel gear mechanism 11 and the brake 15 are located inside the housing 21 of the upper unit 13. The upper bevel gear mechanism 11 connects the input shaft 4 to a vertically arranged intermediate shaft 8 and a lower bevel gear mechanism 12 connects the intermediate shaft 8 to a horizontally arranged propeller shaft 9. A propeller 10 is rigidly fixed to the propeller shaft 9. The lower bevel gear mechanism 12 and the propeller shaft 8 are arranged in a lower unit 14 which protrudes from the bottom 6 of the hull 5.

The brake 15 comprises stationary elements 16 and rotatable elements 17 in the form of friction disks. The rotatable friction disks 17 of the brake 15 are rotationally fixed to a hub 24 of a first bevel gear 18 of the upper bevel gear mechanism 11. The rotatable friction disks 17 and the first bevel gear 18 are arranged to rotate together around rotation axis 22 which is also the rotation axis of the input shaft 4. Hence, the rotatable frictions discs 17 of the brake 15 with the first bevel gear 18 are coaxially aligned with the input shaft 4. The stationary disks 16 are rotationally fixed to the housing 21.

Figure 2:
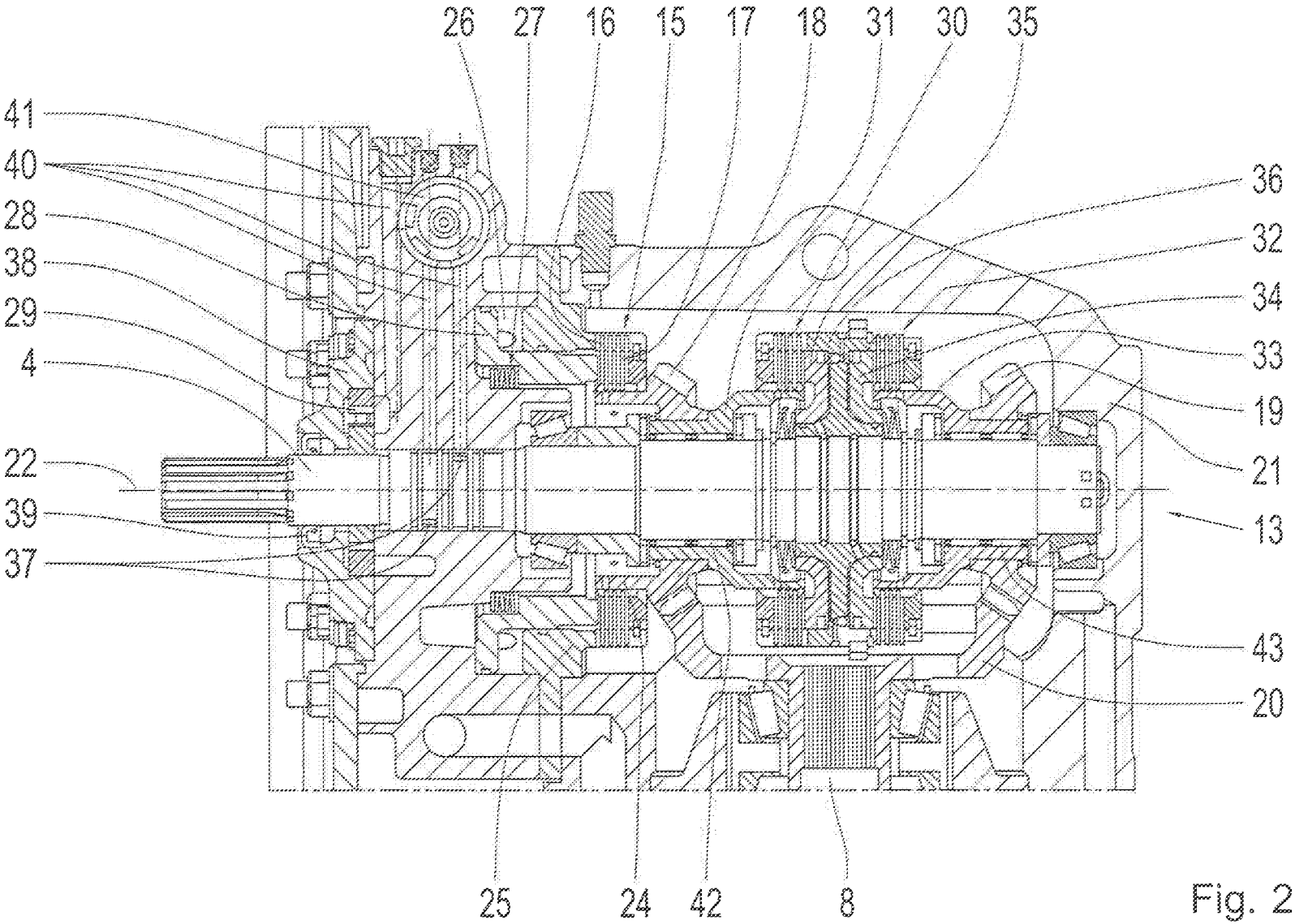
FIG. 2 shows a partial section of the upper unit of a saildrive arrangement according to the invention.

FIG. 2 shows the upper unit 13 of the saildrive arrangement 1 more detailed. The brake 15 is engageable by a locking spring 27 and disengageable by hydraulic pressure provided by a hydraulic pump 29 which is driven by the input shaft 4. When the engine 2 is running the input shaft 4 is driven by the output shaft 3 and the hydraulic pump 29 on the input shaft 4 provides hydraulic pressure to a pressure chamber 26. The hydraulic pressure in pressure chamber 26 acts on a pressure piston 28 and moves it in axial direction away from the friction disks 16, 17 of the brake 15 as soon a certain pressure level is reached. In FIG. 2 the assembly it shown when the engine 2 is running and the brake 15 is disengaged by the hydraulic pressure.

As soon as the hydraulic pressure decreases below said pressure level, the locking spring 27 will press the pressure piston 28 in axial direction towards the friction disks 16, 17 of the brake 15, thereby locking the brake 15. Hence, the propeller shaft 9 is locked. This will happen as soon as or shortly after the engine 2 is stopped. The locking spring 27 is formed by several cup springs which press the pressure piston 28 against the friction disks 16, 17. The cup springs are biased against the housing 21 to enable the cup springs to generate the friction force for the spring-actuated brake 15. This way it is ensured, that a rotation of the propeller is prevented when the engine is not running.

The upper bevel gear mechanism 11 comprises a first bevel gear 18, a second bevel gear 19 and a third bevel gear 20. The first bevel gear 18 and the second bevel gear 19 are both arranged rotationally around a rotation axis 22 of the input shaft 4. The first and second bevel gears 18 and 19 are constantly meshing with the third bevel gear 20 which is rotationally fixed to the intermediate shaft 8. The third bevel gear 20 is fixed to the intermediate shaft 8 and rotates together with the intermediate shaft 8 around a vertical axis 23 during operation of the saildrive.

The first bevel gear 18 and the second bevel gear 19 are selectively fixable to the input shaft 4 by closing the corresponding first clutch 26 or second clutch 27 in order to engage a forward or reverse propulsion direction. This means that either first bevel gear 18 or the second bevel gear 19 can be fixed to the input shaft 4. When both clutches 26 and 27 are open, none of the bevel gears 18, 19 is fixed to the input shaft 4. In this case the saildrive runs in an idle gear with no driving connection between the engine 2 and the propeller shaft 9 is realized.

The first clutch 30 and the second clutch 32 are both hydraulic multi-disk clutches which are engageable by a pressure provided by hydraulic pump 29 which is driven by the input shaft 4. There is only one hydraulic pump 29 to provide hydraulic pressure to the brake 15 and to the first clutch 30 and the second clutch 32.

Inner clutch disks of the first clutch 30 are rotationally fixed to a first inner clutch disk carrier 31. Said first inner clutch disk carrier 31 is fixed to the first bevel gear 18. The first inner clutch disk carrier 31 is supported on the input shaft 4 by a first needle bearing 42. Inner clutch disks of the second clutch 32 are rotationally fixed to a second inner clutch disk carrier 33. Said second inner clutch disk carrier 33 is fixed to the second bevel gear 19. The second inner clutch disk carrier 33 is supported on the input shaft 4 by a second needle bearing 43.

Outer clutch disks of the first and second clutch 30 and 32 are rotationally fixed to outer clutch disk carrier 36. The outer clutch disk carrier 36 is fixed to the input shaft 4. Additionally the outer clutch disk carrier 36 carries a first and a second clutch piston 34 and 35 which limit the pressure chambers of the first and the second clutch 30, 32 and provide the necessary force for clutch engagement as soon as hydraulic pressure is provided to the corresponding pressure chamber.

The hydraulic pump 29 in this embodiment is a positive displacement pump which is positioned right beside the feedthrough for the input shaft 4 in housing 21. Rotatable parts of the hydraulic pump 4 are fastened directly on the input shaft 4. Stationary parts of the hydraulic pump 4 are fastened inside a sealing cover 38 of housing 21 of the upper unit 13. All parts of the hydraulic pump 29 are positioned inside the sealing cover 38. The sealing cover 38 is equipped with a sealing ring 39 around the input shaft 4 at said feedthrough to protect the upper unit 13 from oil leakage and contamination from the outside.

Pressure bores 40 and a hydraulic valve 41 are provided inside a wall of the housing 21 of the upper unit 13 to selectively connect the pressure chambers 26 of the brake 15 or the first or second clutch 30, 32 with hydraulic pressure. There are further hydraulic pressure channels 37 provided inside the input shaft 4 and inside the outer clutch disk carrier 36 to connect the hydraulic pump 29 with pressure chambers of the first clutch 30 and the second clutch 32. This means that all components of the hydraulic system for the brake 15 and the first and second clutch 30 and 32 are part of the upper unit 13 and located inside the housing 21 of the upper unit 13.

Figure 3:
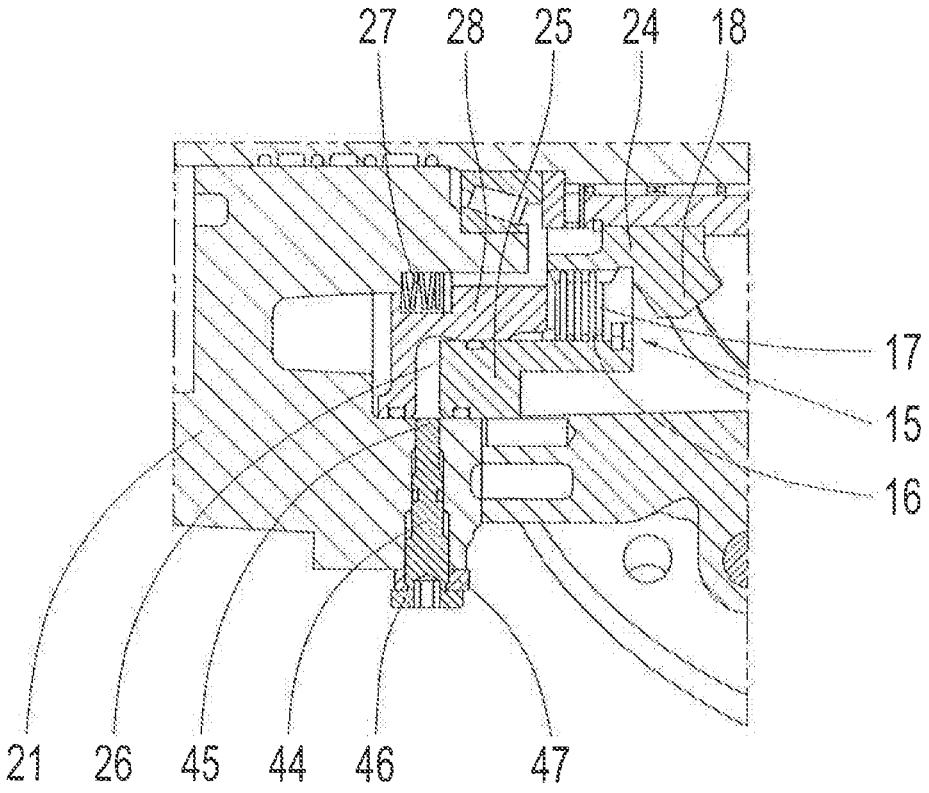
FIG. 3 shows another partial section with the disabling element in an idle position and FIG. 4 shows the partial section of FIG. 3 with the disabling element in a disabling position.
Figure 4:
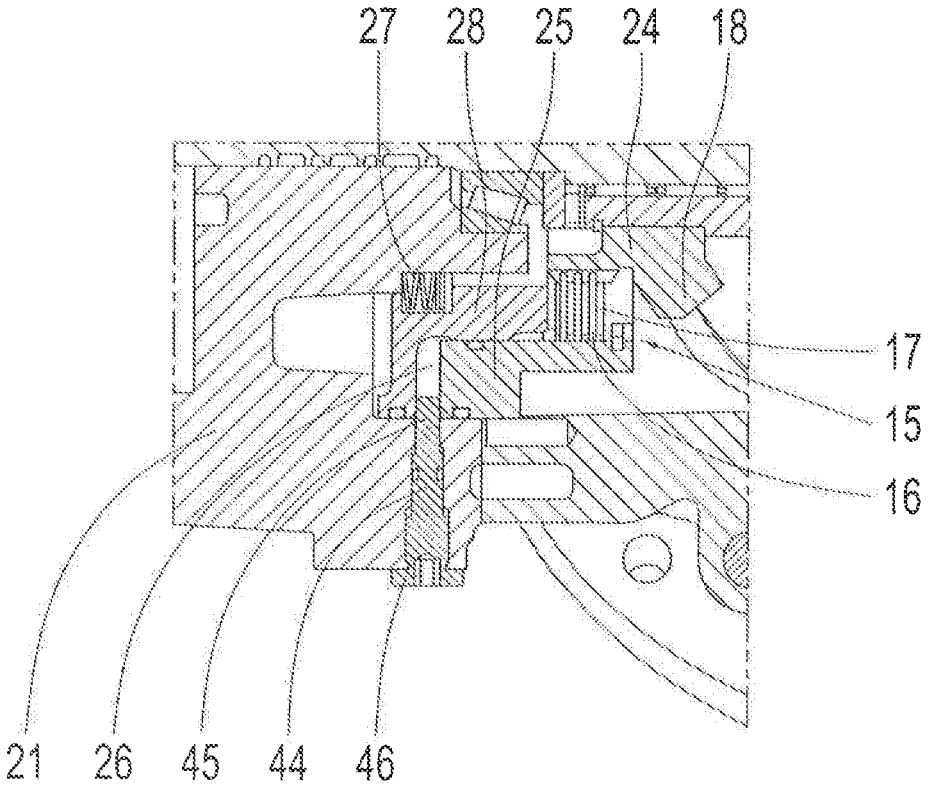

FIG. 3 and FIG. 4 both show a section of a part of the upper unit 13 with the disabling element 44. By means of the disabling element 44 the brake 15 can be disabled mechanically, for example in sailboats with fixed propellers which shall rotate during sailing. FIG. 3 shows the disabling element in an idle position, so that the brake is enabled. FIG. 4 shows the disabling element 44 in the disabling position, so that the brake 15 cannot be used and the disengaged position of the brake 15 is secured by the disabling element 44.

The disabling element 44 is formed as a threaded pin which can be screwed into the housing 21 of the saildrives upper unit 13. In the disabling position in FIG. 4 a front part 45 of the threaded pin 44 positively locks the pressure piston 28 of the brake 15 in a disengaged position of the brake 15. The brake 15 is mechanically disabled.

Whereas in the idle or retracted position of the threaded pin 44 as shown in FIG. 3 the pressure piston 28 of the brake 15 is not blocked by the front part 45 of the threaded pin 44. The pressure piston 28 will be pressed against the stationary and rotatable elements 16, 17, that are the pressure plates of the brake 15 by the force of spring 27, as long as the force generated on the pressure piston 28 by the hydraulic pressure in pressure chamber 26 is lower than the force of spring 27. A spacer 47 is arranged between the head 46 of the threaded pin 44 and the housing 21 in order to fasten the threaded pin 44 in its predefined idle position. Hence, the brake can easily be enabled and disabled from outside of the housing 21, by screwing in or out the threaded pin 44 and placing the spacer 47 as indicated.

REFERENCE NUMERAL

1 saildrive arrangement
2 engine
3 output shaft
4 input shaft
5 hull
6 bottom
7 sailboat
8 intermediate shaft
9 propeller shaft
10 propeller
11 upper bevel gear mechanism
12 lower bevel gear mechanism
13 upper unit
14 lower unit
15 brake
16 stationary element
17 rotatable element
18 first bevel gear
19 second bevel gear
20 third bevel gear
21 housing
22 rotation axis
23 vertical axis
24 hub
25 brake disk carrier
26 pressure chamber
27 spring
28 pressure piston
29 hydraulic pump
30 first clutch
31 first inner clutch disk carrier
32 second clutch
33 second inner clutch disk carrier
34 first clutch piston
35 second clutch piston
36 outer clutch disk carrier
37 pressure channels
38 sealing cover
39 sealing ring
40 pressure bores
41 hydraulic valve
42 first needle bearing
43 second needle bearing
44 disabling element
45 front part
46 head
47 spacer

The invention claimed is:

1. A saildrive arrangement comprising:

an upper unit for positioning inside a hull of a sailboat, and a lower unit for being arranged to protrude from a bottom of the hull, the upper unit comprising an input shaft for connection to an engine, and the lower unit comprising a propeller shaft, wherein a brake, to lock the rotational movement of the propeller shaft, is located in the upper unit.

2. The saildrive arrangement according to claim 1, wherein the upper unit comprises an upper bevel gear mechanism which connects the input shaft to an intermediate shaft, and the lower unit comprises a lower bevel gear mechanism which connects the intermediate shaft to the propeller shaft.

3. The saildrive arrangement according to claim 2, wherein a rotatable element of the brake is rotationally fixed to a hub of a first bevel gear of the upper bevel gear mechanism and a stationary element of the brake is rotationally fixed to a housing of the saildrive arrangement.

4. The saildrive arrangement according to claim 3, wherein the rotatable and the stationary elements of the brake comprise at least one friction disk.

5. The saildrive arrangement according to claim 1, wherein the brake is engageable by a locking spring and disengageable by hydraulic pressure supplied by a hydraulic pump which is driven by the input shaft.

6. The saildrive arrangement according to claim 2, wherein the upper bevel gear mechanism comprises a first bevel gear and a second bevel gear which are both arranged rotatable around a rotation axis of the input shaft and the first and the second bevel gears are constantly meshing with a third bevel gear which is rotationally fixed to the intermediate shaft, wherein the first and the second bevel gears are selectively fixable to the input shaft by a first clutch and a second clutch respectively in order to engage a forward propulsion direction or a reverse propulsion direction.

7. The saildrive arrangement according to claim 6, wherein the first clutch and the second clutch are both hydraulic multi-disk clutches which are engageable by a pressure supplied by a hydraulic pump which is driven by the input shaft.

8. The saildrive arrangement according to claim 7, wherein hydraulic pressure channels are provided inside the input shaft to connect the hydraulic pump to the first clutch and the second clutch.

9. The saildrive arrangement according to claim 7, wherein the hydraulic pump is positioned inside a cover of a housing of an upper unit of the saildrive arrangement.

10. The saildrive arrangement according to claim 1, wherein the saildrive arrangement comprises a disabling element for mechanically disabling the brake.

11. The saildrive arrangement according to claim 10, wherein the disabling element is a screw bolt which can be screwed into a housing of the saildrive arrangement until a front part of the disabling element positively locks a pressure piston of the brake in a disengaged position.

12. A sailboat with a hull and a saildrive, the saildrive comprising an engine which is positioned inside the hull and a saildrive arrangement comprising:

an upper unit for positioning inside the hull of the sailboat, and a lower unit for being arranged to protrude from a bottom of the hull, the upper unit comprising an input shaft for connection to an engine, and the lower unit comprising a propeller shaft, wherein a brake, to lock the rotational movement of the propeller shaft, is located in the upper unit.

* * * * *